US007384207B2

(12) United States Patent
Bhavnani

(10) Patent No.: US 7,384,207 B2
(45) Date of Patent: Jun. 10, 2008

(54) ERGONOMIC HAND HELD IMPLEMENT WITH RETRACTABLE TIP

(75) Inventor: Dilip Bhavnani, Beverly Hills, CA (US)

(73) Assignee: Sun Coast Merchandise Corp., Commerce, CA (US)

( * ) Notice: Subject to any disclaimer, the term of this patent is extended or adjusted under 35 U.S.C. 154(b) by 250 days.

(21) Appl. No.: 11/012,392

(22) Filed: Dec. 14, 2004

(65) Prior Publication Data

US 2006/0127160 A1 Jun. 15, 2006

(51) Int. Cl.
*B43K 24/02* (2006.01)
*A46B 5/02* (2006.01)

(52) U.S. Cl. ..... 401/112; 401/109; 401/6; 401/29; 401/33; 401/117

(58) Field of Classification Search ..... 401/6–8, 401/29–33, 112, 117, 99, 109, 111
See application file for complete search history.

(56) References Cited

U.S. PATENT DOCUMENTS 2,031,839 A * 2/1936 Limbach ..... 401/55
3,994,605 A * 11/1976 McKnight ..... 401/99
4,227,823 A * 10/1980 Kitzerow ..... 401/99
D292,297 S * 10/1987 Bingham ..... D19/41
4,906,119 A * 3/1990 Hartford et al. ..... 401/6
D359,508 S 6/1995 Debbas
5,527,124 A * 6/1996 Kolaric ..... 401/6
5,564,849 A * 10/1996 Greer, Jr. ..... 401/30
5,785,443 A 7/1998 Rubin
6,328,494 B1 12/2001 Moxon
6,428,231 B1 * 8/2002 Shamitoff ..... 401/117
6,795,057 B2 9/2004 Gordon
7,044,668 B2 * 5/2006 Shamitoff ..... 401/112

* cited by examiner

*Primary Examiner*—Khoa D. Huynh
(74) *Attorney, Agent, or Firm*—The Soni Law Firm

(57) ABSTRACT

An improved hand-held implement is provided with a body having external surfaces that define contours which match and ergonomically engage the surfaces of a user's thumb and fingers when the user grasps the implement, so as to provide a large surface area of contact between the user's hand and the implement. The increased area of contact between the user's hand and the implement, compared to traditional designs, decreases the required level of applied unit area pressure, and also provides for greater control consequently facilitating manipulation of the implement. The exterior of the implement is sufficiently small so that, while in use, the body of the implement does not extend outside or beyond the hand of the user. The cartridge includes a coaxial retention ring device which readily fits into the body of the implement by the resilient engagement of the ring into the coaxial recessed groove in the implement body. The implement is further provided with a spring operated mechanism for extending and retracting the tip from the cartridge. The outer surfaces of the implement, having relatively smooth flat surface, are well-suited for application of art work, logos and graphics for advertising and promotional purposes.

28 Claims, 3 Drawing Sheets

ERGONOMIC HAND HELD IMPLEMENT WITH RETRACTABLE TIP

FIELD OF THE INVENTION

The present invention is directed to a small implement to be held in one's hand, as might be typically used for writing, with a readily removable cartridge. Examples of such implements include writing implements such a pens and pencils, cutting implements such as knives, awls and scribes, and other hand-held implements such as brushes, cosmetics applicators, soldering devices and computer styluses.

BACKGROUND OF THE INVENTION

In the past, traditional hand-held implements, such as those commonly used for writing, have generally been provided with a cylindrical shaft which is manipulated by the thumb and index finger of the user acting in conjunction with each other to control the tip of the device so as to accomplish a specified task. Additionally, the users of such traditional cylindrical shaft implements may often utilize the arch as a lever against the working thumb and index finger as a fulcrum, in order to manipulate the implement. Examples of such traditional single tip hand-held implements are writing instruments such as pens and pencils, cutting instruments such as knives and awls, tools such as soldering devices and scribes, painting instruments such as brushes, cosmetics application equipment and digitalizing contacting devices such as computer styluses. During their use, the surface of such traditional implements contacts a relatively small surface area of the user's skin.

Historically, improvements to such traditional hand-held implements concerned the mechanical aspects of the implements, such as new inks, ink flow mechanisms and delivery of the ink to the writing surface. A fundamental disadvantage of traditional implements is that they have only a single rigidly mounted working tip and the ubiquitous cylindrical shaft does not conform well to the surfaces of the user's fingers, palm or closed inner hand.

One of the least developed areas of hand-held implement design is the relationship between the grasping shape of the implement and the natural shape of the user's hand. This has a significant effect on the user's comfort and ability to control and manipulate the implement, particularly when the implement is to be used for a prolonged period of time. Conventional implements contact a relatively small proportion of the surface area of the user's fingers, leaving a large area of the thumb and fingers unused. Further, the bulk of the user's hand is not used to dissipate the physical stress that accompanies the use of the hand-held implement. This situation eventually leads to discomfort for the user over a period of use, as the rigid surfaces of the implement exert pressure (in the form of negative leverage) and friction on the user's fingers. Thus, it is advantageous that a larger percentage of the surface area of the hand and fingers which work with a hand-held implement should contribute to controlling the hand-held implement.

Prior attempts were made to modify hand-held implements to reduce discomfort and fatigue. For example, implements have been produced which have soft rubber coating materials. However, such materials tend to reduce the control of the implement in the hand and easily become soiled. Also, it has been proposed to provide hand-held implements with different concave surfaces. However, these concave surfaces have not overcome the basic problems arising from the basic idea of a cylindrical shaft oriented to extend in a direction between the thumb and index finger of the user and out away from the hand.

Rubin, in U.S. Pat. No. 5,785,443, described a handheld writing instrument with a similar body shape. However, Rubin's design lacks any mechanism for variably extending the implement tip from the main body and retracting the implement tip into the main body. This inability is a major disadvantage, for example, preventing a pen from being stored in a pocket without risking damage to clothing and preventing the inadvertent marking on surfaces other than the target area.

SUMMARY OF THE INVENTION

The present invention is directed to providing an ergonomic hand-held implement with a removable cartridge and a retractable tip implement.

Another object of the invention is to provide a ergonomic hand-held implement which can be held with a high degree of comfort for long periods of time with reduced fatigue of the hand. The present invention will provide an ergonomic hand-held implement which provides less friction and pressure on the contacting surfaces of the hand, thereby reducing the development of blisters or calluses on the fingers or hand, for example, along the third finger which result from friction and pressure during extended use.

Another object of the invention is to provide an ergonomic hand-held implement which allows for performing manual activity with a high degree of precision. The present invention provides an ergonomic hand-held implement of smaller dimensions, but which provides a greater proportion of it's surface in contact with the hand, thus enabling a greater degree of control and manipulation while simultaneously providing for greatly increased comfort.

The present invention accomplishes these and other objectives by providing a hand-held implement which has a cartridge and cartridge housing from which a working tool extends and retracts, for example, a pen or pencil point, independent of the structural mounting requirements of the working tip. Thus, the implement can then be provided with an ergonomically shaped body, with the body preferably having a forward surface and an opposing rearward surfaces, and contiguous and generally perpendicular thereto, first and second side surfaces. The forward, rearward, and two side surfaces define a round bulb-shaped top portion and a contiguous narrower bottom portion. The top portion is ergonomically contoured so as to be fitted within the palm of a user. One of the side surface is adapted to engage the thumb of a user and the other is adapted to engage the middle finger of the user. The forward surface is adapted to be engaged by the index finger of the user, and the surfaces are oriented so that in use the implement extends in a direction which is no further toward the user's thumb than the user's index finger. The implement is of sufficient size so that the implement fits comfortably in the palm and does not extend outside the palm of the user, such that the instrument provides a greater conformation with the contours of the thumb, second and third fingers of the hand, and the closed palm, when the implement is in the position in which the device is used. In so doing, a relatively large contact area exists between the hand and the instrument. The increased area of contact decreases the pressure at any given point of contact, and the increased area of contact also allows for greater control of the instrument. The instrument of the present invention may be advantageously used in multiple manually performed activities utilizing hand-held instruments, including for example, writing, painting, cutting, soldering, surgery, and cosmetics application by simple replacement of the cartridge.

The present invention will satisfy the above described needs yet it is an improved design over previous ergonomic designs because it incorporates a retractable tip mechanism. In the present invention, a spring loaded plunger incorporating a dual position chevron shaped cam way is advanced upon the press of a button so as to apply an axial force upon the spring loaded cartridge and thereby alternatively extend or retract the implement tip. Having the capability to retract the tip provides the user with the ability to safety and cleanly carry the implement in a pocket or other clothing article. With the tip retracted, ink would not leak onto clothing or cause inadvertent marking of clean surfaces. Moreover, if the implement is configured as a cutting tool, stylus point or other sharp pointed article, the user would now be able to retract the point to have a safe implement for transport storage or other use when exposure of the sharp tip is not required.

Other objects, advantages and features of the present invention will be more readily appreciated and understood when considered in conjunction with the following detailed description as drawings.

BRIEF DESCRIPTION OF THE DRAWINGS

These and other aspects of the present invention will now be described with reference to the accompanying drawings, in which.

DETAILED DESCRIPTION OF THE INVENTION

The purpose of the improved hand-held implement described by the present invention is to present a working tip for the user. In the illustrated embodiments, an ink tip 13 is shown as a working tip incorporated in a pen cartridge. However, the working tip can include any one of a number of devices which require precise manual control. Examples include other writing implements such as pencils and fountain pens, the blade for a cutting implement, a brush for painting, a brush or puff for cosmetic application, a soldering tip or a contacting device such as a computer stylus.

Figure 1:
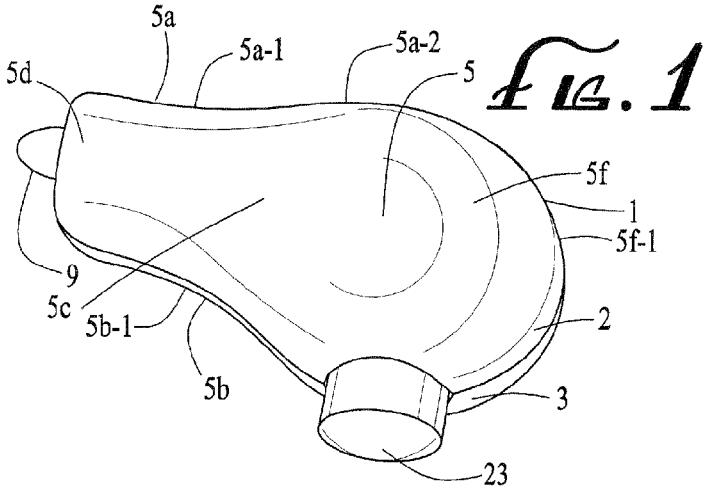
FIG. 1 illustrates a perspective view of an improved hand-held implement, according to the present invention in a fully assembled state with the working tip retracted.
Figure 2:
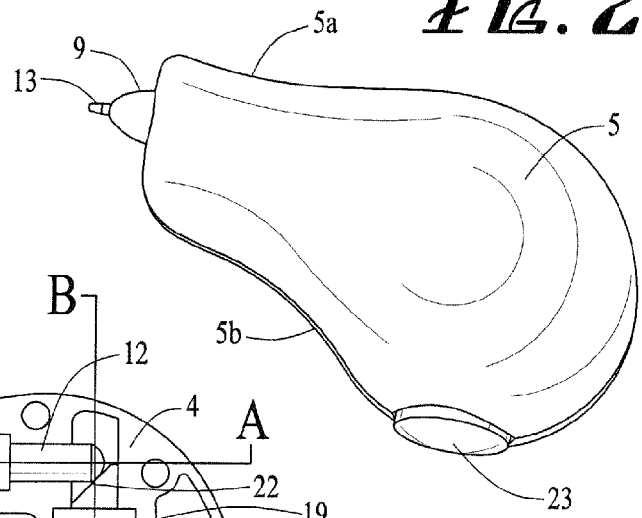
FIG. 2 illustrates a perspective view of a the improved hand-held implement according to the present invention in a fully assembled state with the working tip extended.

In a preferred embodiment, as shown in FIGS. 1 and 2, the assembled body 1 of the hand held implement would be constructed of two mating pieces, the first curved body panel 2, and the second curved body panel 3. These two pieces would be attached or bonded during the assembly process through common methods, such as snap fitting tabs, sonic welding or adhesive. The assembled body has a first axis A and a second axis B. The second axis B generally perpendicularly intersects the first axis A. Each of these panels would have an inner surface 4 and an outer surface 5. In use of the assembled body 1 of the implement, the outer surface 5 of the first body panel 2 is engaged by the thumb of a right handed user and the outer surface S of the second body panel 3 is engaged by the middle finger of the user. In this preferred embodiment, the outer surfaces 5 have contours which are smooth and gradual, without sharp edges. Similarly, the two mating body panels 2, 3 of the implement are joined smoothly, with rounded edges. These features enhance the level of comfort for the user of the implement. More specifically, as shown in FIGS. 1 and 2 in the preferred embodiment, the outer surfaces 5 define a smooth ergonomic shape having a forward surface 5*a* and an opposed rearward surface 5*b*, and a first side surface 5*c* and an opposed second side surface 5*d* which are contiguous and generally perpendicular to the forward and rearward surfaces 5*a* and 5*b*. Part of the four surfaces 5*a*, 5*b*, 5*c*, and 5*d* define a bottom portion 5*e* and an opposed and contiguous top portion 5*f*. The top portion 5*f* has a generally round bulb shape, as seen in FIGS. 1 and 2, and a first convex contour 5*f*-1 smoothly connecting between the forward and rearward surfaces 5*a* and 5*b* such that the top portion 5*f* can be ergonomically fit within the palm of the user. The forward surface 5*a* is contoured such that the user would typically place their index finger thereon substantially parallelly in a direction toward the bottom portion 5*c*. For that, the forward surface 5*a* may have a first concave contour 5*a*-1 and further, a contiguous second convex contour 5*a*-2 as shown in FIG. 1. Preferably, the first side surface 5*c* is adapted to engage the thumb of a user. The middle finger of the user, on the other hand, rests preferably on the second side surface 5*d*, and in addition, may rest the curved forward surface 5*a* upon the distal knuckle area of the middle finger. Furthermore, the rearward surface 5*b* also may have a concave contour 5*b*-1 as shown in FIG. 1. This placement of the thumb, index finger and middle finger permits the user to comfortably grip the improved implement, yet hold the implement in a manner quite conducive to accurate and precise positioning of the tip 9 of the implement. Thus, the present invention in use permits the hand of the user to assume a comfortable arched configuration, with the implement being substantially co-planar with the arch defined by the index finger and corresponding portion of the surrounding closed palm of the user. This preferred embodiment of the implement is of a sufficiently small length that it does not extend beyond the hand of the user, but rather fits within the user's hand.

In a particularly preferred embodiment, the width of the implement is thin enough so as to facilitate storage of the implement in a pocket of the user's clothing.

In this preferred embodiment, the surfaces 5, 5*a* and 5*b* are oriented so that the implement in use will extend in a direction which is preferably essentially parallel to the user's index finger, but in any event, a direction which is no further toward the thumb of the user than the index finger. This relationship can also be conceptualized by considering the tip 9 as defining a longitudinal axis, which is preferably substantially parallel to the index finger of the user.

Figure 3:
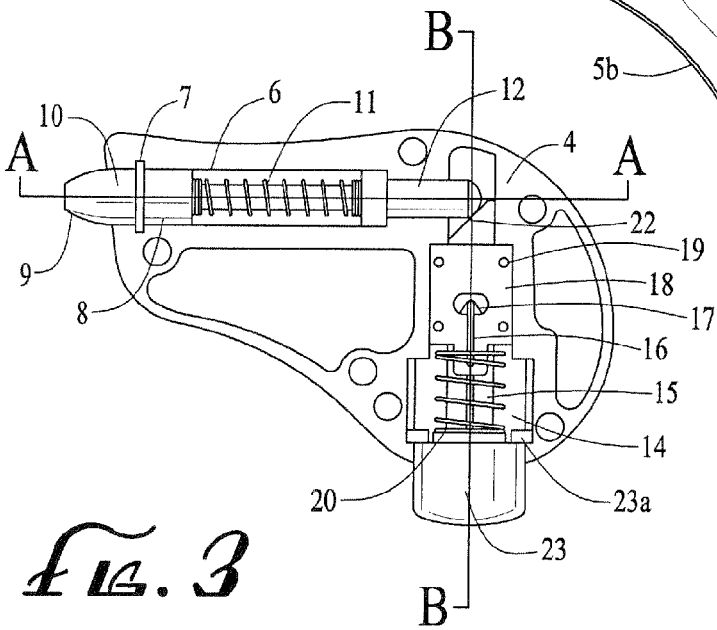
FIG. 3 illustrates a sectional view of the improved hand-held implement with the working tip retracted as shown in FIG. 1.
Figure 4:
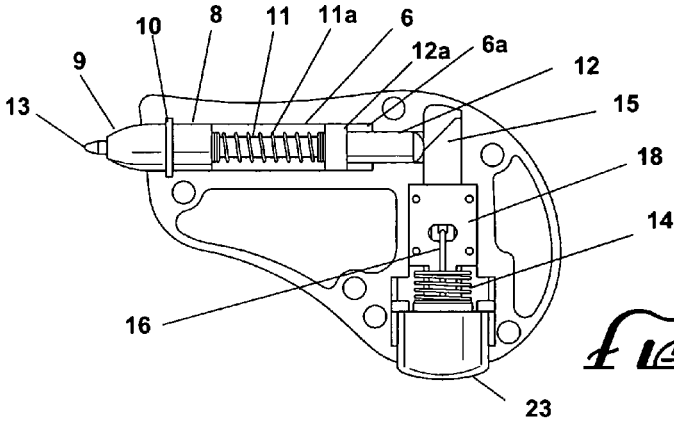
FIG. 4 illustrates a sectional view of the improved hand-held implement with the working tip extended, as shown in FIG. 2.
Figure 6:
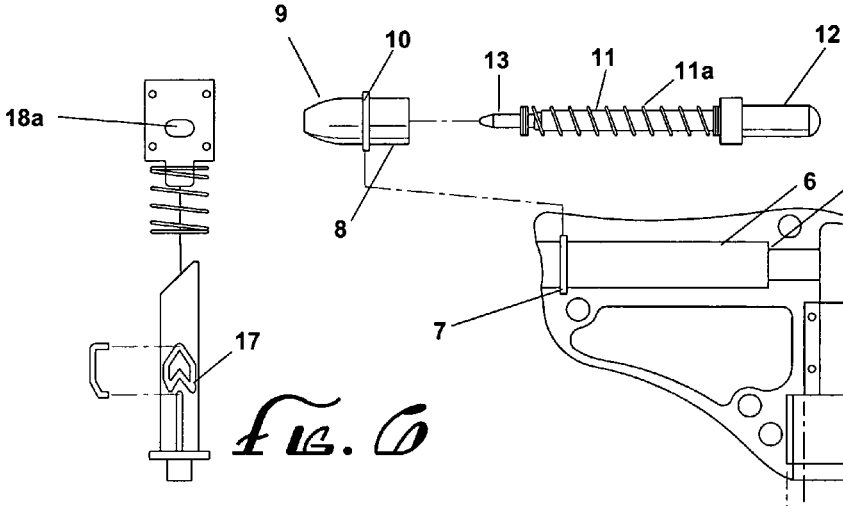
FIG. 6 illustrates an top exploded view of the selection peg, cam way and plunger body of an improved hand-held implement according to the present invention as shown in FIG. 1.
Figure 7:
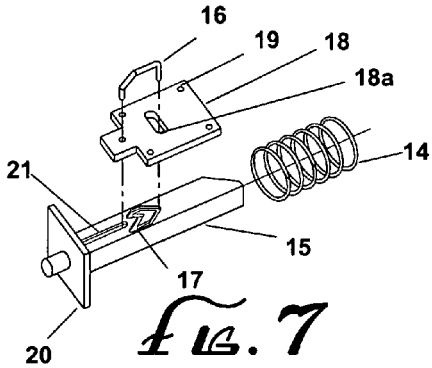
FIG. 7 illustrates an perspective exploded view of the selection peg, cam way and plunger body of an improved hand-held implement according to the present invention as shown in FIG. 1.
Figure 5:
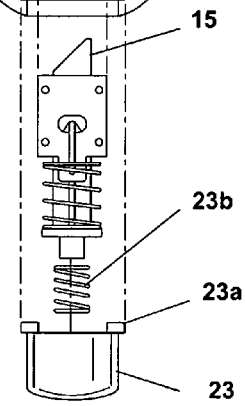
FIG. 5 illustrates an exploded view of the improved hand-held implement shown in FIG. 3, further depicting the cartridge, cartridge housing and plunger mechanism.

Referring to FIGS. 3 and 4, a cartridge housing 6 according to the present invention includes one or more coaxial cavities 7, depicted in FIG. 5 as a coaxial groove, for retention of the cartridge 8 and tip 9. In a preferred embodiment, the cartridge housing 6 is cylindrical and elongated. However, the cartridge 8 can be any shape (including square, oblong, conical, etc.) and need not be elongated. A cartridge 8 extends from the cartridge housing 6 and contains the tip 9.

Referring to FIG. 5, an exploded view of a hand-held implement according to the present invention is shown. It can be seen that the external shape of the body 1 does not correspond to the external shape of the cartridge housing 6. Both the body 1 and the cartridge housing 6 may independently have any longitudinal shape. Also, both the body 1 and the cartridge housing 6 may independently have any cross-sectional shape. In a preferred embodiment, the external shape of the hand-held implement is contoured as described above. In a more preferred embodiment, the cross sectional area encompassed by the body 1 is significantly larger than the cross sectional area encompassed by the cartridge housing 6 and the shortest dimension of the body 1 is longer than the shortest dimension of the cartridge housing 6. The first body panel 2 and the second body panel 3 of the hand-held implement according to the present invention fit together to form the cartridge housing 6. The cartridge housing 6 may be located anywhere within the body 1 and extend from any facet of the body 1. A tip 9 extends from the cartridge 8 and the cartridge housing 6. In a preferred embodiment, the cartridge 8 is a pen cartridge having an ink tip 13.

The coaxial retention stopper 10 of the cartridge 8 is located at a particular distance from the outward end of the cartridge 8 and tip 9. In the assembled body 1, the stopper 8, shown in the preferred embodiment as a circular shoulder, fits into the coaxial cavity 7 to locate and retain the cartridge 8 in the cartridge housing 6. The predetermined length of the cartridge 8 and location of the stopper 10 with respect thereto defines the desired extension distance of the tip 9, and in the preferred embodiment, of the ink tip 13. The stopper 10 and cavity 7 may be of any cross sectional geometry and size appropriate to mate such that they function in unison to locate and retain the cartridge 8.

Referring to FIG. 5, a pen cartridge 8 according to the present invention is shown. In a preferred embodiment, the pen cartridge 8 has an ink refill including a rounded cylindrical portion 12, a spring wrapped ink reservoir 11 and an ink tip 13. The inner end of the cylindrical portion 12 is slidably engaged with the inclined angled surface 22 of the plunger body 15 for retraction and extension of the ink tip 13, as described below.

In the invention, whatever type of extending tip is incorporated in the cartridge is alternatively extendable and retractable. In the preferred embodiment, the ink tip 13 may be extended from or retracted into the tip 9. This is accomplished by the use of spring loaded mechanisms. First, the cylindrical portion 12 of the cartridge 8 is spring biased against the cartridge housing 6. Compression of the cartridge spring 11*a* is accomplished through the controlled length of the cartridge housing 6, which includes the length from the coaxial cavity to the innermost end 6*a* of the cartridge housing 6, upon which a shoulder 12*a* of the cylindrical portion 12 is biased. Thus, in a relaxed state whereby the shoulder 12*a* is in contact with the innermost end 6*a*, the ink tip 13 is retracted into the cartridge. Again, regardless of the extending tip configuration, it would be retracted in this position. This would be particularly useful toward safety if the tip were a stylus, knife point or other sharp or pointed tip.

Figure 8:
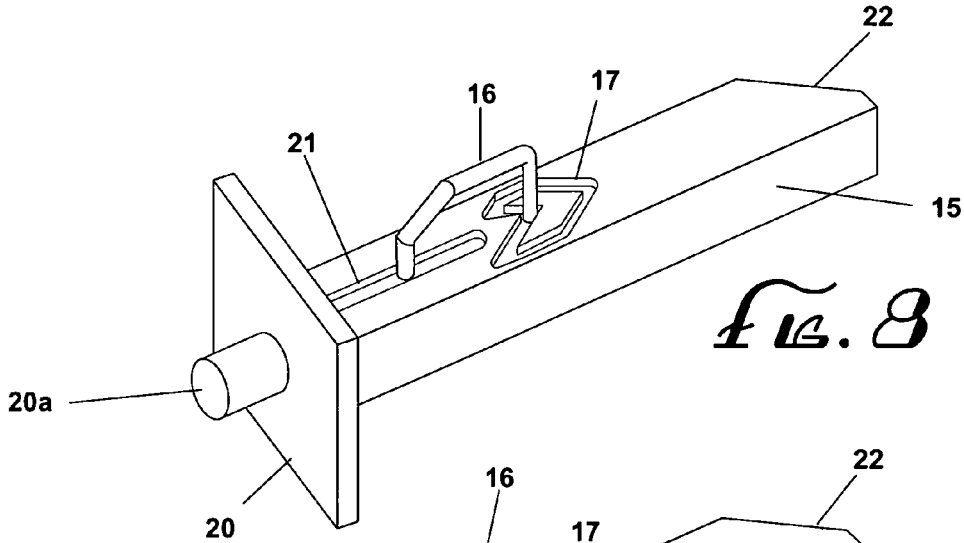
FIG. 8 illustrates an perspective view of the selection peg, cam way and plunger body of an improved hand-held implement in the working tip extended position according to the present invention as shown in FIGS. 2 and 4.
Figure 9:
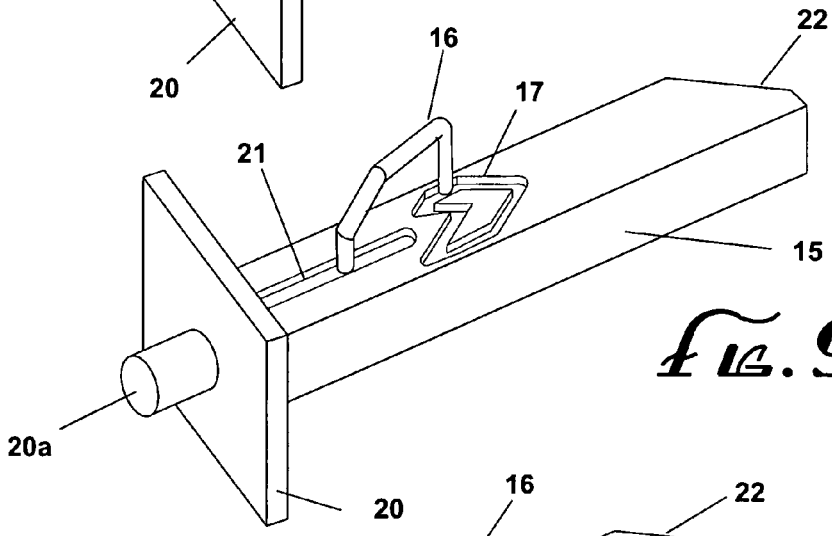
FIG. 9 illustrates an perspective view of the selection peg, cam way and plunger body of an improved hand-held implement at a point in the working tip extension stroke position according to the present invention as shown in FIGS. 3 and 4.
Figure 10:
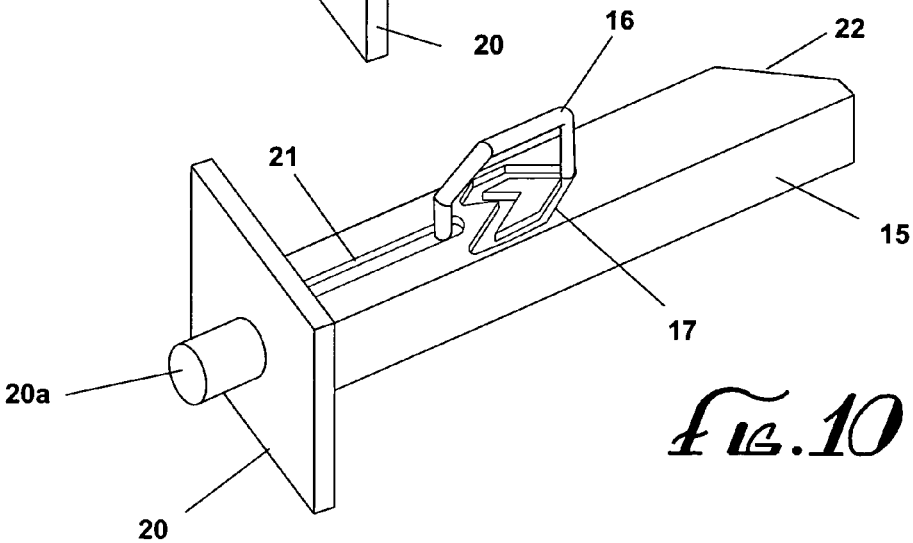
FIG. 10 illustrates an perspective view of the selection peg, cam way and plunger body of an improved hand-held implement in the working tip retracted position according to the present invention as shown in FIGS. 1 and 3.

The preferred embodiment accomplishes the extension of the ink tip 13 by means of a spring biased plunger mechanism, which includes a button, 23, a spring 14, a plunger body 15, a selection peg 16, a cam way 17, and a top plate 18, which is attached to the inner surface 4 of the second body panel 3 by means of multiple attachment points 19. The button 23 in the preferred embodiment is generally cylindrical with an oblong cross section. Its inboard end includes outward extending tabs 23*a*, on two opposing sides to permit the button 23 to extend outward from the assembled body 1 but still be retained within the body by the tabs 23*a*. Inside the button 23 resides a button spring 23*b*, which exerts an inward axial force upon the flat plate 20 of the plunger body 15. The plunger body 15 may be configured of any cross sectional shape but is shown in the preferred embodiment as an elongated piece having a square cross section. On its outboard end, the plunger body 15 has a flat plate 20 with a locator pin 21 centered on the outer facing surface of the flat plate 20. The locator pin 21 locates and guides the force of the button spring 23*b* on the flat plate 20. The inner end of the plunger body 15 is configured with an inclined angled surface 22 as its end point. The selection pin 16 is generally "U" shaped and the outer leg fits into the slide groove 21 of the plunger body 15, with the inner leg inserted into the cam way 17 of the plunger body 15. The selection pin 16 is inserted through the top plate 18 and is held in place by the spring 14, which warps around the selection pin 16 as well as around the plunger body 15. As the user depresses the button 23, the button spring 23*b* applies an axial inward force upon the flat plate 20. This force displaces the plunger body 15 axially inward, thus moving the cam way 17 inward. The selection pin 16 is not displaced axially, as it is retained through the center hole 18*a* in the top plate 18 as well as the inward radial force upon the selection pin 16 resulting from the wrapped coils of the spring 14. The outer leg of the selection pin 16 thus is confined to ride in the slide groove 21 of the plunger body 15. The inner leg of the selection peg 16 follows the elongated chevron shape of the cam way 17, as the cam way 17 moves laterally with the spring controlled movement of the plunger body 15. Referring to FIGS. 8, 9 and 10, upon first depression of the button 23, the selection peg slides down the front side leg of the cam way 17 and rests in the outer "V" portion of the cam way 17 to extend the ink tip 13. A second pressing of the button causes the selection pin 16 to follow the rear profile of the cam way 17, and the selection pin 16 comes to rest in the inner "V" portion of the chevron cam way 17, whereupon the ink tip 13 is fully retracted.

This movement of the cam way 17 and plunger body 15 is locked in the above described extension and retraction positions by the location of the selection pin 16 in either the outer "V" portion of the cam way 17 (See FIG. 8) or the inner "V" portion of the cam way 17 (See FIG. 10), respectively. The lateral movement of the plunger as described above correspondingly moves the end point of the inclined angled surface 22. As this inclined angled surface 22 moves inward due to the axial force of the button spring 23*b* as applied by pressing the button 23, it is slidably engaged with the inner end of the cylindrical portion 12 of the cartridge 8. Although the relative geometry may vary based upon the lengths, sizes and resultant angles, in the preferred embodiment, the plunger body is coplaner with but oriented at approximately 90 degrees with respect to the cartridge 8 and cartridge housing 6. Accordingly, the angle of the inclined angled surface 22, is approximately 45 degrees and slopes rearward, such that its leading edge is lower than its trailing edge. Thus, as the plunger body 15 advances laterally inward, the sliding engagement of the inclined angled surface 22 with the cylindrical portion 12 of the cartridge 8 results in an axial force pushing outward upon the cylindrical portion 12 of the cartridge 8, thereby extending the ink tip 13, which is linearly connected to the cylindrical portion 12 of the cartridge 8.

The improved hand-held implement can be of any suitable dimensions consistent with the above relationships. The implement can be scaled up or down so as to provide different implements of different sizes which can thereby accommodate users with different size hands. The implement of the present invention can be made of any material suitable for the intended purpose of the implement. Examples include various polymeric materials, metal, wood and glass. It should also be noted that the outer surfaces 5, of the body 1 of the device provide a relatively smooth flat surface which is well-suited for application of art work, logos and advertising.

While there is shown and described herein certain specific structures embodying this invention for the purpose of clarity of understanding, the same is to be considered as illustrative in character, it being understood that only preferred embodiments have been shown and described. It will be manifest to those skilled in the art that certain changes, various modifications and rearrangements of the parts may be made without departing from the spirit and scope of the underlying inventive concept and that the same is not limited to the particular forms herein shown and described except insofar as indicated in the scope of the claims.

What is claimed is:

1. An improved hand-held implement comprising:

an ergonomic assembled body having:

a first curved body panel having a first inner surface and a first outer surface, and a second curved body panel, having a second inner surface and a second outer surface, attached to said first body panel forming said ergonomic assembled body, a portion of the first and second inner surfaces of said assembly body defining an elongated cartridge housing therebetween, said elongated cartridge housing extends longitudinally and coaxially along a first axis of said assembled body;

an elongated cartridge coaxially retained within said cartridge housing, said cartridge having a tip; and a spring biased plunger positioning in another portion of the first and second inner surfaces of said assembly body and extending longitudinally and coaxially along a second axis of said assembly body, said second axis generally perpendicularly intersecting said first axis, said plunger having an inclined angled surface formed on an end thereof and biased against an end of the cartridge such that depression of the plunger alternately extends and retracts the tip of said cartridge out of or into said assembly body, wherein said first and second outer surfaces define:

a bottom portion from which said elongated cartridge extends or retracts, and an opposed top portion, a forward surface extending between said bottom and top portions, said forward surface being adapted to be engaged by, and extend in a direction substantially parallel to, the index finger of a user, first and second opposed side surfaces extending between said bottom and top portions and rearward from said forward surface, said first side surface being adapted to engage the thumb of a user, said second side surface being adapted to engage another finger of a user, and a rearward surface, said first and second side surfaces extending between said forward surface and said rearward surface, said forward and rearward surfaces being contiguous and generally perpendicular to said side surfaces.

2. The improved hand held implement of claim 1, wherein said outer surface of said first curved body panel and said outer surface of said second curved body panel define an ergonomic body having:

a bottom portion from which said elongated cartridge extends;

a forward surface extending upward from the bottom portion, the forward surface being adapted to be engaged by and extend in a direction substantially parallel to the index finger of a user;

first and second opposed side surfaces extending upward from the bottom portion and rearward from the forward surface, the first opposed side surface being adapted to engage the thumb of a user, the second opposed side surface being adapted to engage the side of a third finger of a user;

a rearward surface, the first and second side surfaces extending between said forward surface and said rearward surface; and a first convex contour smoothly joining said forward surface and said rearward surface, said first convex contour being adapted to fit within the palm of a user.

3. The improved hand held implement of claim 2, wherein the rearward surface has a concave contour smoothly joined to the first convex contour.

4. The improved hand held implement of claim 3, wherein the forward surface, the first and second side surfaces and the first convex contour define a bulbous upper portion above the concave contours of the side surfaces.

5. The improved hand held implement of claim 3, wherein the forward surface comprises a concave contour and the concave contours of the side surfaces extend between the concave contours of the forward and rearward surfaces.

6. The improved hand held implement of claim 2, wherein the forward surface comprises a first concave contour and a second convex contour extending between the first convex contour and the first concave contour.

7. The improved hand held implement of claim 6, wherein the first concave contour is adjacent the bottom portion.

8. The improved hand held implement of claim 1, wherein the inner surface of at least one of the first and second panels is provided with an abutment tab for limiting movement of the cartridge housing in the assembled body.

9. The improved hand held implement of claim 1, wherein the cartridge housing is cylindrical.

10. The improved hand held implement of claim 1, wherein the receptacle is rectilinear.

11. The improved hand held implement of claim 1, wherein the cartridge further comprises an ink pen.

12. The improved hand held implement of claim 1, wherein the cartridge further comprises an implement selected from the group comprising pencil, highlighter, laser pointer, and stylus.

13. The improved hand held implement of claim 1 wherein advertising or graphical material is imprinted on at least one outer surface of the implement for the purpose of advertising or promotion.

14. An improved hand-held implement comprising:

an ergonomic assembled body having:

a first curved body panel having a first inner surface and a first outer surface, and a second curved body panel, having a second inner surface and a second outer surface, attached to said first body panel forming said ergonomic assembled body, a portion of the first and second inner surfaces of said assembly body defining an elongated cartridge housing therebetween, said elongated cartridge housing extends longitudinally and coaxially along a first axis of said assembled body;

an elongated cartridge having an outboard end and an opposing inboard end, said cartridge having a tip projecting from said outboard end and a coaxial retention stopper which fits into a mating coaxial cavity defined by the cartridge housing, said cartridge being coaxially retained within said cartridge housing via the retention stopper; and a spring biased plunger positioning in another portion of the first and second inner surfaces of said assembly body and extending longitudinally and coaxially along a second axis of said assembly body, said second axis generally perpendicularly intersecting said first axis, said spring biased plunger slidably engaged with a cylindrical portion having a first end connected to the opposing inboard end of the elongated cartridge, said spring biased plunger having an inclined angled surface formed on an end thereof and biased against the cylindrical portion such that depression of the plunger engages a second opposite end of the cylindrical portion to alternately extend and retract the tip from the cartridge, said spring biased plunger further comprising a selection peg and a cam way where upon a first depression of the plunger the peg slidably engages and rests in an extension leg point of the cam way and upon a second depression of the plunger the peg slidably engages and rests in a retraction leg point of the cam way.

15. The improved hand held implement of claim 14, wherein said outer surface of said first curved body panel and said outer surface of said second curved body panel define an ergonomic body having:

a bottom portion from which said elongated cartridge extends;

a forward surface extending upward from the bottom portion, the forward surface being adapted to be engaged by and extend in a direction substantially parallel to the index finger of a user;

first and second opposed side surfaces extending upward from the bottom portion and rearward from the forward surface, the first opposed side surface being adapted to engage the thumb of a user, the second opposed side surface being adapted to engage the side of a third finger of a user;

a rearward surface, the first and second side surfaces extending between said forward surface and said rearward surface; and a first convex contour smoothly joining said forward surface and said rearward surface, said first convex contour being adapted to fit within the palm of a user.

16. The improved hand held implement of claim 15, wherein the rearward surface has a concave contour smoothly joined to the first convex contour.

17. The improved hand held implement of claim 16, wherein the forward surface, the first and second side surfaces and the first convex contour define a bulbous upper portion above the concave contours of the side surfaces.

18. The improved hand held implement of claim 16, wherein the forward surface comprises a concave contour and the concave contours of the side surfaces extend between the concave contours of the forward and rearward surfaces.

19. The improved hand held implement of claim 15, wherein the forward surface comprises a first concave contour and a second convex contour extending between the first convex contour and the first concave contour.

20. The improved hand held implement of claim 19, wherein the first concave contour is adjacent the bottom portion.

21. The improved hand held implement of claim 14, wherein the inner surface of at least one of the first and second panels is provided with an abutment tab for limiting movement of the cartridge in the assembled body.

22. The improved hand held implement of claim 14, wherein the cartridge housing is cylindrical.

23. The improved hand held implement of claim 14, wherein the receptacle is rectilinear.

24. The improved hand held implement of claim 14, wherein the cartridge further comprises an ink pen.

25. The improved hand held implement of claim 14, wherein the cartridge further comprises an implement selected from the group comprising pencil, highlighter and stylus.

26. The improved hand held implement of claim 14, wherein advertising or graphical material is imprinted on at least one outer surface of the implement for the purpose of advertising or promotion.

27. A method of advertising or promotion comprising the imprinting of graphical or advertising material on at least one surface of an improved hand-held implement having:

an ergonomic assembled body having:

a first curved body panel having a first inner surface and a first outer surface, and a second curved body panel, having a second inner surface and a second outer surface, attached to said first body panel forming said ergonomic assembled body, a portion of the first and second inner surfaces of said assembly body defining an elongated cartridge housing therebetween, said elongated cartridge housing extends longitudinally and coaxially along a first axis of said assembled body;

an elongated cartridge coaxially retained within said cartridge housing, said cartridge having a tip; and a spring biased plunger positioning in another portion of the first and second inner surfaces of said assembly body and extending longitudinally and coaxially along a second axis of said assembled body, said second axis generally perpendicularly intersecting said first axis, said plunger having an inclined angled surface formed on an end thereof and biased against an end of the cartridge such that depression of the plunger alternately extends and retracts the tip of said cartridge out of or into said assembly body, wherein said first and second outer surfaces define:

a bottom portion from which said elongated cartridge extends or retracts 1 and an opposed top portion, a forward surface extending between said bottom and top portions, said forward surface being adapted to be engaged by, and extend in a direction substantially parallel to, the index finger of a user, first and second opposed side surfaces extending between said bottom and top portions and rearward from said forward surface, said first side surface being adapted to engage the thumb of a user, said second side surface being adapted to engage another finger of a user, and a rearward surface, said first and second side surfaces extending between said forward surface and said rearward surface, said forward and rearward surfaces being contiguous and generally perpendicular to said side surfaces.

28. A method of advertising or promotion comprising the imprinting of graphical or advertising material on at least one surface of an improved hand-held implement having:

an ergonomic assembled body having:

a first curved body panel having a first inner surface and a first outer surface, and a second curved body panel, having a second inner surface and a second outer surface, attached to said first body panel forming said ergonomic assembled body, a portion of the first and second inner surfaces of said assembled body defining an elongated cartridge housing therebetween, said elongated housing extends longitudinally and coaxially along a first axis of said assembled body;

an elongated cartridge having an outboard end and an opposing inboard end, said cartridge having a tip projecting from said outboard end and a coaxial retention stopper which fits into a mating coaxial cavity defined by the cartridge housing, said cartridge being coaxially retained within said cartridge housing via the retention stopper; and a spring biased plunger positioning in another portion of the first and second inner surfaces of said assembled body and extending longitudinally and coaxially along a second axis of said assembled body, said second axis generally perpendicularly intersecting said first axis, said spring biased plunger slidably engaged with a cylindrical portion having a first end connected to the opposing inboard end of the elongated cartridge, said spring biased plunger having an inclined angled surface formed on an end thereof and biased against the cylindrical portion such that depression of the plunger engages a second opposite end of the cylindrical portion to alternately extend and retract the tip from the cartridge, said spring biased plunger further comprising a selection peg and cam way where upon a first depression of the plunger the peg slidably engages and rests in an extension leg point of the cam way and upon a second depression of the plunger the peg slidably engages and rests in a retraction leg point of the cam way.

* * * * *